US011578277B2

(12) United States Patent
Das et al.

(10) Patent No.: US 11,578,277 B2
(45) Date of Patent: Feb. 14, 2023

(54) SIMULTANEOUS PROCESSING OF CATALYTIC AND THERMALLY CRACKED MIDDLE DISTILLATE FOR PETROCHEMICAL FEEDSTOCK

(71) Applicant: INDIAN OIL CORPORATION LIMITED, Maharashtra (IN)

(72) Inventors: Nayan Das, Faridabad (IN); Mainak Sarkar, Faridabad (IN); Ganesh Vitthalrao Butley, Faridabad (IN); Ramesh Karumanchi, Faridabad (IN); Sarvesh Kumar, Faridabad (IN); Madhusudan Sau, Faridabad (IN); Gurpreet Singh Kapur, Faridabad (IN); Sankara Sri Venkata Ramakumar, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 0 days.

(21) Appl. No.: 17/520,455

(22) Filed: Nov. 5, 2021

(65) Prior Publication Data

US 2022/0135890 A1 May 5, 2022

(30) Foreign Application Priority Data

Nov. 5, 2020 (IN) ..... 202021048365

(51) Int. Cl.
*C10G 65/12* (2006.01)

(52) U.S. Cl.
CPC ..... *C10G 65/12* (2013.01); *C10G 2300/104* (2013.01); *C10G 2300/1048* (2013.01); *C10G 2300/1055* (2013.01); *C10G 2300/202* (2013.01); *C10G 2300/301* (2013.01); *C10G 2300/305* (2013.01); *C10G 2300/307* (2013.01); *C10G 2300/308* (2013.01); *C10G 2300/4018* (2013.01)

(58) Field of Classification Search
CPC ..... C10G 65/12; C10G 2300/104; C10G 2300/1048; C10G 2300/1055; C10G 2300/202; C10G 2300/301; C10G 2300/305; C10G 2300/307; C10G 2300/308; C10G 2300/4018; C10G 51/06; C10G 65/14; C10G 69/04; C10G 69/06; C10G 45/02; C10G 45/32; C10G 45/44; C10G 47/00; C10G 2400/02; C10G 2400/04; C10G 2400/06; C10G 9/005; C10G 9/007; C10G 11/18
See application file for complete search history.

(56) References Cited

U.S. PATENT DOCUMENTS 8,142,645 B2 3/2012 Zhou et al.
8,404,103 B2 3/2013 Dziabala et al.
(Continued)

FOREIGN PATENT DOCUMENTS

WO 2007/039047 A1 4/2007

*Primary Examiner* — Randy Boyer
*Assistant Examiner* — Juan C Valencia
(74) *Attorney, Agent, or Firm* — Maschoff Brennan

(57) ABSTRACT

The present invention discloses an integrated process scheme for producing (i) high-octane gasoline blending stream (ii) high aromatic heavy naphtha stream which is a suitable feedstock for benzene, toluene, and xylene (BTX) production and (iii) high cetane ultra-low sulphur diesel (ULSD) stream suitable for blending in refinery diesel pool.

11 Claims, 2 Drawing Sheets

(56) References Cited

U.S. PATENT DOCUMENTS

| | | | | |
|---|---|---|---|---|
| 9,644,155 | B2 | 5/2017 | Butley et al. | |
| 2006/0118464 | A1* | 6/2006 | Kaines | C10G 45/02 208/89 |
| 2015/0267130 | A1* | 9/2015 | Butley | C10G 65/08 568/321 |

* cited by examiner

SIMULTANEOUS PROCESSING OF CATALYTIC AND THERMALLY CRACKED MIDDLE DISTILLATE FOR PETROCHEMICAL FEEDSTOCK

FIELD OF THE INVENTION

The present invention describes an integrated process for converting the middle distillate boiling range streams obtained from catalytic cracking as well as thermal cracking units to (i) high-octane gasoline blending stream, (ii) high aromatic heavy naphtha, feedstock for BTX production and (iii) high cetane ultra-low sulphur diesel (ULSD), suitable for blending in refinery diesel pool.

BACKGROUND OF THE INVENTION

The middle distillate boiling range stream from fluid catalytic cracking (FCC) units and resid fluid catalytic cracking (RFCC) units are called light cycle oil (LCO). In a typical refinery configuration, the LCO stream is routed to the diesel pool after reducing sulphur through high pressure hydro-treating. Currently in most refinery configurations, LCO is the second highest contributor to the refinery diesel pool after straight run diesel. However, because of its property, LCO only adds volume to the pool without contributing anything to its quality; in fact, it deteriorates some of the important pool properties such as cetane number (CN) and density. LCO is in the diesel boiling range and has 95 vol. % recovery temperatures at about 360° C. However, due to high aromatics content, hydro-treating of LCO at high pressure only reduces the sulphur content but does not significantly improve CN and in most cases it is 10-15 units lower as compared to that required for meeting the EURO-VI diesel specification. Further, the specific gravity of the hydrotreated LCO is in the range of 0.87 to 0.89, whereas for EURO-VI diesel, the specific gravity requirement is only 0.845 (maximum). Therefore, hydrotreating LCO at very high pressure (90-105 bar g $H_2$ partial pressure) and converting the aromatics to naphthenes with only moderate improvement in CN is inefficient utilization of costly hydrogen.

An alternate approach for utilizing the LCO stream is to convert it to feedstock for aromatic complex for production of valuable chemicals such as benzene, toluene and xylene (BTX). In this process, the di- and tri-aromatics present in the LCO steam are selectively converted to alkyl benzene by saturating the second and the third ring respectively and then opening the saturated ring by mild hydrocracking. In this route, the chemical potential of the LCO stream is utilized to its fullest extent. However, in this route, moderate hydrogen pressure (25-75 bar g) needs to be maintained for maximizing the alkyl benzene concentration in the product stream for protecting the mono-aromatics already present in the LCO stream and those formed during the course of reaction. Therefore, the CN of the unconverted oil (UCO) generated in the process is considerably low. As the unconverted stream is in the diesel boiling range and has sulphur content below 10 ppmw, it is blended in the refinery diesel pool. However, only because of low CN and high density this stream requires further hydro-processing.

High aromatic content in the middle distillate streams of any thermal or catalytic cracker unit is the major hurdle in incorporating these streams into the refinery diesel pool. On hydrotreating these streams, the multi-ring aromatics get converted to mono-aromatics but with fused naphthenic ring (i.e., naphtha, benzene). The saturation of first or second ring occurs at very low hydrogen partial pressure; whereas the saturation of last aromatic ring requires very high hydrogen partial pressure. Even on saturating all the aromatic rings, the CN improvement is very insignificant compared to the hydrogen consumption. Therefore, efforts are being made for profitably utilizing these types of streams. Some of the previous works closely related to the present invention have been discussed in brief.

U.S. Pat. No. 8,404,103 by Honeywell UOP LLC discloses a technique for converting high aromatic stream into ultra-low sulphur gasoline and diesel by optimizing hydrotreater severity and allowing nitrogen slippage in the range of 20 to 60 ppmw into hydrocracker feed for enhancing the research octane number (RON) of the gasoline. The gasoline cut has a RON value of at least 85 and the diesel cut has less than 10 ppmw of sulphur, but no disclosure is provided on the cetane number of the diesel.

U.S. Pat. No. 8,142,645 by Hydrocarbon Technology & Innovation LLC discloses a method for conversion of polynuclear aromatics of cycle oil and pyrolysis fuel oil into higher value mono-aromatic compounds, such as benzene, toluene, xylenes, and ethyl benzene. The catalytic metal in the catalyst complexes is in the center surrounded by organic ligands. During hydrocracking procedure, the organic ligand preserves one of the aromatic rings of the poly-nuclear aromatic compounds, while the catalytic metal breaks the other aromatic rings thereby yielding a mono-aromatic compound. The process for the conversion of LCO to BTX exemplified has been carried out at higher pressure (~96 bar g) and the monoaromatic/alkyl aromatic concentration in the product is very low (~20 wt. %). It mainly focuses on catalyst preparation and does not describe the properties of the diesel/gasoline produced in the process. The process uses homogenous catalyst system which will lead to complication in separation of the metals from the products.

U.S. Pat. No. 9,644,155 by Indian Oil Corp Ltd. describes an integrated process to produce high-octane gasoline, high aromatic naphtha and high cetane diesel. The feedstock used in this process is a cracked middle distillate such as LCO from an FCC unit containing at least 30 wt. % of multi-ring aromatics. The RON of gasoline cut obtained in this process is at least 85. Also, this process produces a high aromatics naphtha cut with a RON of 91. The main disadvantage associated with the process is that the diesel stream obtained by this process has cetane number of at least 42 units and further oxidation reaction needs to be done to lower the cetane number by another 8-9 units.

WO patent publication WO2007039047A1 by Haldor Topsoe A/S discloses a partial conversion hydrocracking process and an apparatus whereby heavy petroleum feed is hydrotreated and hydrocracked and produces ultra-low sulphur diesel (ULSD) and high-quality FCC feed. Particularly, it also refers to the use of different catalyst beds in a hydrocracking reactor. Although, no advantage has been linked to use of different catalyst beds.

From the referred prior arts, attempts have been made for profitably utilizing the middle distillate boiling range streams obtained from catalytic as well as thermal cracker units. The main disadvantages associated with the processes known in the art are not being able to achieve an optimum cetane number, homogenous catalyst system leading to complication in separation of the metals from the products, oxidation required to lower the cetane number, etc. Therefore, a process for converting middle distillate boiling range streams from catalytic as well as thermal cracker units is needed to overcome the disadvantages.

SUMMARY OF THE PRESENT INVENTION

Based on the cracking methodology and the feed characteristics, the properties of the middle distillate range boiling streams obtained from different types of cracking units vary widely. For example, the aromatics content in middle distillates obtained from catalytic cracking units (FCC or RFCC) is very high compared to that obtained from thermal cracker units such as Delayed Coker units or Visbreaker. There are also a lot of variations in other physical and chemical properties.

The present invention provides an integrated process for converting middle distillate boiling range streams from catalytic as well as thermal cracker units to (i) high-octane gasoline blending stream, (ii) high aromatic heavy naphtha, feedstock for BTX production and (iii) high cetane ultra-low sulphur diesel (ULSD) suitable for blending in refinery diesel pool, by utilizing the potential of each stream to its fullest extent.

Technical Advantages of the Invention

The present invention has the following advantages over the cited prior arts:

1. Simultaneous processing of middle distillate from both catalytic and thermal cracker,
2. Sorting of molecules based on their chemical composition and properties,
3. Placing the right molecules in the right stream of product to derive full potential of that molecule,
4. Simultaneous production of petrochemical feedstock and EURO-VI/BS-VI diesel,
5. Interface process for integration of refinery with petrochemical complex,
6. Optimizing the pressure of conventional diesel hydrotreating unit, as it will be only used for upgrading straight run middle distillate streams,
7. Process acts as bridge between refinery and petrochemical complex,
8. The process produces ULSD with higher cetane value and gasoline with high RON.

Objectives of the Invention

It is a primary objective of the present invention to provide a process for conversion of middle distillate range boiling streams originating from catalytic crackers to (i) high-octane gasoline blending stream, (ii) high aromatic heavy naphtha, suitable for producing BTX, and (iii) high cetane ultra-low sulphur diesel (ULSD) suitable for blending in refinery diesel pool.

It is a further objective of the present invention to provide a process for conversion of middle distillate obtained from thermal cracking units (viz. delayed coker, flexi coker, visbreaker, etc.) in the same process for production of high cetane diesel simultaneously.

ABBREVIATIONS

Figure 1:
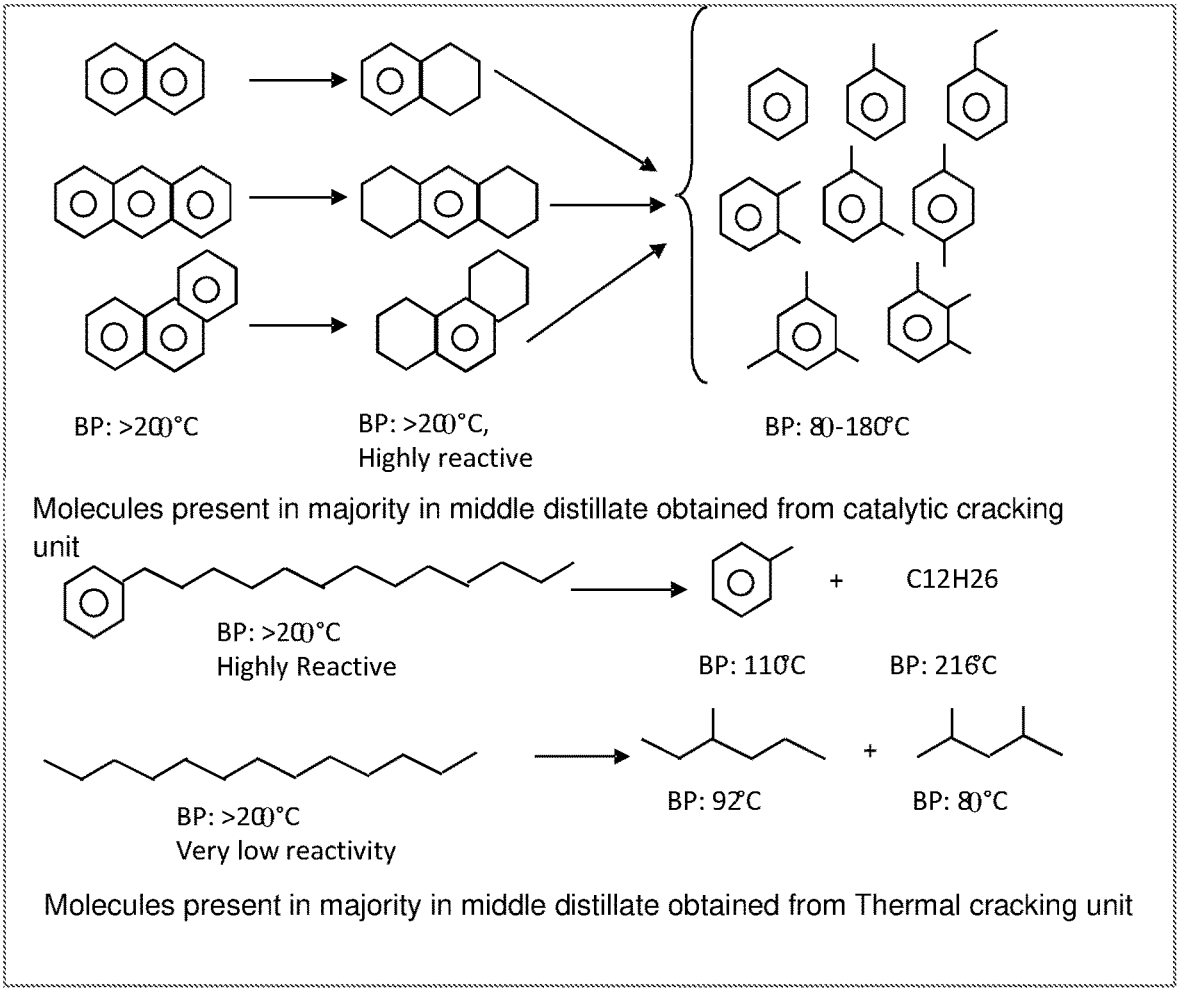
FIG. 1 illustrates the reaction scheme involved in the process.

BTX: Benzene, toluene and xylene
CN: Cetane number
ULSD: Ultra-low sulphur diesel
FCC: Fluid catalytic cracking
RFCC: Resid fluid catalytic cracking
LCO: Light cycle oil
UCO: Unconverted oil
RON: Research octane number
IBP: Initial boiling point
FBP: Final boiling point
PAH: Polycyclic aromatics hydrocarbon
DCU: Delayed Coker unit
LHSV: Liquid hourly space velocity
CGO: Coker gas oil
MRU: Micro reactor unit
WABT: Weighted average bed temperature

DETAILED DESCRIPTION OF THE INVENTION

Those skilled in the art will be aware that the present disclosure is subject to variations and modifications other than those specifically described. It is to be understood that the present disclosure includes all such variations and modifications. The disclosure also includes all such steps of the process, features of the system, referred to or indicated in this specification, individually or collectively, and any and all combinations of any or more of such steps or features.

Definitions

For convenience, before further description of the present disclosure, certain terms employed in the specification, and examples are collected here. These definitions should be read in the light of the remainder of the disclosure and understood as by a person of skill in the art. The terms used herein have their meanings recognized and known to those of skill in the art, however, for convenience and completeness, particular terms and their meanings are set forth below.

The articles "a", "an" and "the" are used to refer to one or to more than one (i.e., to at least one) of the grammatical object of the article.

The terms "comprise" and "comprising" are used in the inclusive, open sense, meaning that additional elements may be included. It is not intended to be construed as "consists of only".

Throughout this specification, unless the context requires otherwise the word "comprise", and variations such as "comprises" and "comprising", will be understood to imply the inclusion of a stated element or step or group of element or steps but not the exclusion of any other element or step or group of element or steps.

The term "including" is used to mean "including but not limited to". "Including" and "including but not limited to" are used interchangeably.

Unless defined otherwise, all technical and scientific terms used herein have the same meaning as commonly understood by one of ordinary skill in the art to which this disclosure belongs. Although any methods and materials similar or equivalent to those described herein can be used in the practice or testing of the disclosure, the preferred methods, and materials are now described. All publications mentioned herein are incorporated herein by reference.

The present disclosure is not to be limited in scope by the specific embodiments described herein, which are intended for the purposes of exemplification only. Functionally equivalent products and methods are clearly within the scope of the disclosure, as described herein.

The present invention discloses a process for converting middle distillate range boiling streams originating from both thermal and catalytic crackers to (i) high-octane gasoline blending stream, (ii) high aromatic heavy naphtha, suitable for BTX production, and (iii) high cetane ultra-low sulphur diesel suitable for blending in refinery diesel pool.

In the present invention, the high-octane gasoline blending stream has a boiling point in a range of C5 to 95° C., preferably C5 to 80° C. and more preferably a C5 to 65° C. C5 refers to the boiling point of pentane and its isomers. Generally, the boiling point of pentane and its isomers varies between 9-36° C. The research octane number (RON) of this stream is between 80 and 95 units, preferably between 85 and 95 units and more preferably between 88 and 92 units.

In this process, the high aromatic heavy naphtha has a boiling point between 95° C. and 210° C., preferably between 85° C. and 200° C. and more preferably between 65° C. and 180° C. The aromatic content in this stream is between 50 and 80 wt. %, and preferably between 65 and 75 wt. %. The RON of this stream is between 90 and 105 unit, preferably between 93 and 100 units and more preferably between 93 and 98 units.

Additionally, the high cetane ultra-low sulphur diesel (ULSD) has a boiling point of more than 210° C.

The unconverted oil (UCO) in this process refers to a stream with initial boiling point (IBP) above 210° C., preferably 200° C. and most preferably 180° C. The CN of this stream is above 50 units and preferably above 51 units. The specific gravity of this stream is below 0.85 and preferably below 0.845.

In one embodiment, the sulphur content of all the streams generated by this process is below 10 ppmw.

In one embodiment, the middle distillate boiling range streams originating from the catalytic cracker units are high in aromatic content compared to those originating from thermal cracking units. The middle distillate boiling range stream obtained from catalytic cracking units and thermal cracking units are also referred to as catalytically cracked and thermally cracked middle distillates, respectively.

The middle distillate boiling range streams obtained from catalytic cracking units such as FCC and RFCC are high in aromatic content and generally known as light cycle oil (LCO). The total aromatics content in such stream generally varies from 50 to 90 wt. % depending on the operating severity of the unit. The aromatic content in LCO stream from high severity cracking units such as RFCC is very high compared to low severity FCC unit. Further, the FCC process hydrotreated VGO contains less aromatics in LCO stream compared to FCC process untreated VGO or atmospheric residue. The LCO comprises of about 20-30 wt. % mono-aromatics, 60-70 wt. % di-aromatics and about 5-10 wt. % polycyclic aromatics hydrocarbon (PAH) as aromatics. The PAH rarely contains more than three ring aromatics.

On the contrary, the middle distillate boiling range streams obtained from thermal cracking units such as delayed Coker (DCU), flexi Coker, visbreaker, pyrolysis unit, etc., contains about 20-50 wt. % aromatics and the rest is saturated. The Coker middle distillate also contains olefins not exceeding 5-6 wt. %. The Coker middle distillate comprises of about 10-20 wt. % mono-aromatics, 5-15 wt. % di-aromatics and about 5-15 wt. % polycyclic aromatics hydrocarbon (PAH) as aromatics. The PAH contains up to five ring aromatics.

The detailed characterization of middle distillates obtained from catalytic and thermal cracking units are disclosed in Table 1.

TABLE 1

Characterization of middle distillates obtained from catalytic and thermal cracking units

| Attributes | Middle distillate of Catalytic cracking units | Middle distillate of Thermal cracking units |
|---|---|---|
| Sulphur (wt. %) | 1.0-1.5 | 0.5-1.50 |
| Nitrogen (ppm) | 100-800 | 500-1500 |
| Density @ 15° C. (g/cc) | 0.90-1.0 | 0.86-0.89 |
| Distillation (wt. %) | Temperature (° C.) | |
| 5 | 200 | 259 |
| 30 | 252 | 309 |
| 50 | 274 | 329 |
| 70 | 304 | 347 |
| 95 | 367 | 391 |
| 98 | 389 | 416 |
| Cetane Number | 15-25 | 40-45 |
| Mono Aromatics (wt. %) | 20-30 | 10-20 |
| Di Aromatics (wt. %) | 40-70 | 5-15 |
| PAH (wt. %) | 3-10 | 5-15 |
| Total Aromatics (wt. %) | 65-90 | 20-50 |

In one embodiment, the process for converting the middle distillate range boiling streams originating from catalytic and thermal cracking units to high-octane gasoline blending stream, high aromatic heavy naphtha and high cetane ULSD comprises:

(a) Subjecting the middle distillate streams obtained from catalytic cracking units and thermal cracking units to hydrotreatment in separate hydrotreatment reactors (R-1A and 1B) over any hydrotreating catalyst systems known in the art. The hydrotreating reactor (R-1) is a normal trickle bed plug flow reactor with down flow configuration. The hydrotreating step is particularly done in separate reactor systems to avoid mixing of two feed streams originated from two different sources.

The boiling range of the feed stream originating from the catalytic cracking unit is between 140° C. to 450° C., preferably between 180° C. to 420° C. and more preferably between 200° C. to 400° C. The boiling range of the feed stream originating from thermal cracker units is between 140° C. to 450° C., preferably between 180° C. to 420° C. and more preferably between 200° C. to 400° C. The hydrotreating of the feed streams of two different origins are done at different operating parameters of temperature (T), liquid hourly space velocity (LHSV) and hydrogen to hydrocarbon ratio. However, both the hydrotreaters are maintained at same total pressures to obtain overall pressure balance in the unit. The objective of the hydrotreating step is to remove all hetero-atoms (viz. sulphur, nitrogen, metals, etc.) present in the feed streams, saturate olefins and convert di-, tri- and other poly aromatic compounds to mono-aromatic compounds. The nitrogen content of the hydrotreated streams is below 100 ppmw, preferably below 50 ppmw and more preferably below 20 ppmw.

(b) Subjecting the hydrotreated effluents from the two hydrotreating units (R-1A and 1B) to hydrocracking in a hydrocracker unit/second reactor (R-2) system containing a bed of hydrocracking catalyst suitable for ring opening at mild operating condition. The hydrocracker unit is operated at the same pressure as that of the two hydrotreaters to maintain a single recycle loop for the entire process.

The hydrocracker reactor consists of multiple catalyst beds and provision for both gaseous and liquid quench between the catalyst beds is provided. The molecular composition of the middle distillate streams vary widely based on the cracking mechanism. Therefore, the hydrotreated streams of respective feed stream are introduced at different catalyst beds in the same hydrocracker reactor. The middle distillate stream originating from the catalytic cracker units have higher concentrations of aromatic compounds and particularly di-aromatic compounds. Hence, upon hydrotreating, this stream gets concentrated with benzo-cyclo-paraffin molecules along with some di-aromatic compounds. This stream is introduced at the top bed of the hydrocracker reactor as it contains high concentration of benzo-cyclo-paraffin and di-aromatic molecules. These molecules upon hydrocracking lead to formation of alkyl-benzene, the most desirable component for high aromatic heavy naphtha stream. The middle distillate streams originating from thermal cracker units contain 20-50 wt. % aromatics and 74-46 wt. % saturates. It also contains olefins not exceeding 5-6 wt. %. The Coker middle distillate comprises of about 10-20 wt. % mono-aromatics, 5-15 wt. % di-aromatics and about 5-15 wt. % polycyclic aromatics hydrocarbon (PAH) as aromatics. The PAH contains up to 5 ring aromatics. Therefore, upon hydrotreating, the di-, tri- and PAH molecules are converted to benzo-cyclo-paraffin, benzo-dicyclo-paraffin, along with some di-aromatic compounds. However, the concentration of these molecules in total hydrotreated effluent is lower compared to hydrotreated effluent of catalytically cracked middle distillate. On the contrary, the hydrotreated middle distillate of thermal cracker units contains paraffin molecules (normal and branched) in higher concentration compared to catalytically cracked feed. Therefore, the hydrotreated middle distillate of thermally cracked origin are introduced in the same hydrocracking reactor but at lower beds of catalyst.

(c) Fractionating the effluent from R-2 and sending for distillation to generate three cuts Cut-1: high-octane gasoline blending stream, Cut-2: high aromatic heavy naphtha and Cut-3: high cetane ULSD.

Segregation of feed based on the composition provides following advantages:

1. Optimization of LHSV which reduces side reactions and minimizes unwanted cracked products;
2. Improvement in selectivity of mono aromatics yield and concentration of mono-aromatics in the heavy naphtha fraction which is indicated by the increase in RON of this fraction;
3. Increase in concentration of saturated molecules, particularly paraffin and iso-paraffin molecules in the unconverted fraction boiling above 200° C. Hence, leading to improvement of cetane number and lowering of density of this fraction.

In one embodiment, the hydrocarbon feed for the process comprises of middle distillate range boiling streams preferably boiling between 140° C. to 430° C., preferably between 180° C. to 410° C. and more preferably between 200° C. to 400° C. originating from both catalytic cracking units such as FCCU and RFCCU and thermal cracking units such as delayed Coker unit (DCU). The middle distillate range boiling stream of catalytic cracking units is called light cycle oil (LCO) and the middle distillate range boiling stream of thermal cracking unit is called Coker gas oil (CGO). The thermal cracking unit is not limited to only DCU but also extends to all other units such as visbreaker unit, naphtha cracker unit, etc., where cracking reaction occurs in absence of catalyst system.

In yet another embodiment, the thermally cracked middle distillate in the feed is important for improving the CN of Cut-3 and contributing to the total aromatic concentration of Cut-2. However, the placement of this stream in the second reactor system (hydrocracking reactor) is very vital since it decides the contact time of this stream with hydrocracking catalyst system. In the same embodiment, it is further disclosed that the hydrotreated thermally cracked middle distillate is introduced in the second reactor either at the top of second or third hydrocracking catalyst bed as per the requirement. In another embodiment, the hydrotreated thermally cracked middle distillate can be introduced simultaneously both at the top of second or third hydrocracking catalyst bed of hydrocracker reactor system.

The plausible reaction mechanisms for both catalytic and thermally cracked middle distillate streams for this innovative process scheme is shown in FIG. 1.

The effect of thermally cracked middle distillate on the product properties of Cut-3 is attributed to its distinct chemical composition compared to middle distillate generated from catalytic crackers. In the thermally cracked middle distillates, the aromatic content is only between 20 to 50 wt. % and the rest are saturated hydrocarbons. Further, the saturated hydrocarbons mostly comprise of straight chain aliphatic hydrocarbons. The aromatic molecules present in thermally cracked middle distillates is also very distinct compared to their counter parts present in catalytically cracked middle distillates. The mono-aromatic molecules are major contributors to the total aromatics content; however, contribution of PAH is also significant. In some cases, contribution of PAH is more than di-aromatic hydrocarbons. On the contrary, di-aromatics are major contributors to the total aromatic content in catalytically cracked middle distillates such as LCO. On further analysis of the thermally cracked middle distillates, it is observed that the mono-aromatics present in this stream is associated with long straight chain aliphatic hydrocarbon, which also contributes significantly towards its CN. Because of higher concentration of straight chain aliphatic hydrocarbons and at the same time presence of mono-aromatics with long straight chain aliphatic hydrocarbon substitutes, the CN of thermally cracked middle distillates is also decent compared to catalytically cracked middle distillate. Due to distinct compositional difference, the thermally cracked middle distillates contribute towards enhancing CN of the unconverted stream (Cut-3), whereas catalytically cracked middle distillates contribute towards enhancing the aromatics content and thereby RON of the Heavy Naphtha (Cut-2).

It is a well-documented fact that the reactivity of the hydrocarbon molecules in hydrocracker is in reverse order compared to that in catalytic cracker. In hydrocracker, the paraffinic molecules (straight chain aliphatic hydrocarbon) are the least reactive whereas the aromatic molecules are the most reactive. The reactivity of iso-paraffins and naphthene molecules are in between paraffinic and aromatic species. Because of this specific reactivity order, the straight chain aliphatic hydrocarbons present in the thermally cracked middle distillates are least converted in the R-2 reactor and contribute towards enhancing CN of the unconverted stream (Cut-3), whereas the aromatics present in catalytic and thermally cracked middle distillate streams boiling above 210° C. and preferably above 200° C. are easily converted to benzenes and alkyl benzenes boiling below 200° C. and preferably below 180° C.

The kinetics constant (x) of hydrocracking reaction over a catalyst system, calculated based on first-order power law kinetics is given by the following equation:

$$k = LHSV \times \ln\left(\frac{1}{(1-x)}\right) \quad (1)$$

$$k = k_o \times e^{\left(\frac{-E}{RT}\right)} \quad (2)$$

Where: '$k_o$' is frequency factor, 'LHSV' denotes liquid hourly space velocity (feed throughput/catalyst volume), 'x' denotes the conversion level, 'E' is the activation energy for hydrocracking, 'R' is universal gas constant and 'T' is reaction temperature.

It is observed from equations 1 and 2 that at constant reaction temperature, the conversion x is inversely proportional to the LHSV, i.e., if LHSV increases the conversion decreases and vice versa. In other words, LHSV is inverse of contact time. Therefore, with optimization of LHSV the conversion is controlled.

In one embodiment, if the contact time between thermally cracked middle distillate and the catalyst is increased beyond certain optimum value, hydrocracking of straight chain aliphatic hydrocarbon molecules which are least reactive among all other types of molecules becomes considerably high. This phenomenon will create the dilution effect and thereby lower aromatic concentration of Cut-2. On the other hand, if the contact time between thermally cracked middle distillate and the catalyst is maintained at the optimum level, then the aromatics and PAH molecules present in this stream will be converted to lower boiling alkylbenzene. However, straight chain aliphatic hydrocarbon molecules will be least affected, and they will be end up in the higher boiling fraction and will assist in improving both cetane number and density of Cut-3.

In yet another embodiment, the primary function of R-1 is hydrotreatment of feed for removing metals, heteroatoms (sulphur and nitrogen) and converting di-/tri-aromatics and PAH to mono-aromatics or more precisely to benzo-cyclo-paraffin and benzo-di-cyclo-paraffin molecules. Nitrogen compounds are poison for the R-2 catalyst; hence nitrogen slippage at the R-1 reactor outlet is maintained below 50 ppmw, preferably below 30 ppmw, and more preferably below 20 ppmw. The temperature in R-1 is maintained between 320° C. to 410° C., preferably between 340° C. to 400° C. and more preferably between 350° C. and 380° C. The LHSV is maintained between 0.5 and 1.5 and preferably between 0.7 and 1.2. The hydrogen partial pressure in the reactor is between 25 and 75 bar g, preferably between 35 and 70 bar g and more preferably between 40 and 65 bar g.

The R-2 reactor is dedicated for generating alkyl benzenes boiling below 200° C. and preferably 180° C. The primary reaction of R-2 is ring opening reaction and converting different types of benzo-cyclo-paraffin molecules to alkyl benzenes. Another important reaction is hydrocracking of long aliphatic side chains of mono-aromatic molecules present in the thermally cracked middle distillates, to alkyl benzenes boiling below 200° C. and preferably 180° C. Other hydro-processing/hydrocracking reactions also occur in parallel with the reactions mentioned above. The temperature in R-2 is maintained between 350° C. and 450° C., preferably between 370° C. and 420° C. and more preferably between 380° C. and 410° C. The LHSV is maintained between 0.2 and 2.0 and preferably between 0.2 and 1.5. The pressure for this process is between 25 and 75 bar g, preferably between 35 and 70 bar g and more preferably between 40 and 60 bar g.

In yet another embodiment, the conversion of linear aliphatic hydrocarbon in R-2 is less than 50 wt. %, preferably less than 30 wt. % and more preferably less than 20 wt. %.

In the present invention, the high-octane gasoline blending stream has a boiling point in a range of C5 to 95° C., preferably C5 to 80° C. and more preferably a C5 to 65° C. C5 refers to the boiling point of pentane and its isomers. Generally, the boiling point of pentane and its isomers varies between 9-36° C. The research octane number (RON) of this stream is between 80 and 95 units, preferably between 85 and 95 units and more preferably between 88 and 92 units. Therefore, the FBP for Cut-1 is 95° C., preferably 80° C. and more preferably 65° C.

In this process, the high aromatic heavy naphtha has a boiling point between 95° C. and 210° C., preferably between 85° C. and 200° C. and more preferably between 65° C. and 180° C. The aromatic content in this stream is between 50 and 80 wt. %, and preferably between 65 and 75 wt. %. The RON of this stream is between 90 and 105 unit, preferably between 93 and 100 units and more preferably between 93 and 98 units. Therefore, the IBP and FBP for Cut-2 is 95° C. and 210° C., preferably 85° C. and 200° C. and more preferably 65° C. and 180° C. respectively.

Additionally, the high cetane ultra-low sulphur diesel (ULSD) has a boiling point of more than 210° C. Therefore, the IBP for Cut-3 is adjusted as per the FBP of Cut-2. The IBP for Cut-3 is usually more than 210° C. The cut points of different fractions are adjusted as per the requirement of downstream process or product requirement.

In yet another embodiment, the sulphur in R-2 outlet is below 10 ppmw, preferably below 5 ppmw and more preferably below 2 ppmw. In a further embodiment, sulphur and nitrogen in all the cuts (viz. Cut-1, Cut-2, and Cut-3) are below 10 ppmw and 1 ppmw respectively.

In one embodiment, the specific gravity of Cut-3 (UCO) is below 0.8500, preferably below 0.8450 and more preferably below 0.8400. The cetane number of Cut-3 is above 46, preferably above 48 and more preferably above 51.

In one embodiment, the specific gravity of Cut-3 (UCO), with only hydrotreated middle distillate stream of catalytic cracker (viz. LCO) as feed for R-2 reactor, is above 0.8800, preferably above 0.8900 and more preferably above 0.9000. However, on introducing hydrotreated middle distillate of thermal cracker (viz. CGO) in the Bed-2 or Bed-3 of R-2 reactor, the specific gravity of Cut-3 drastically reduces below 0.8500, preferably below 0.8450 and more preferably below 0.8400. Similarly, with hydrotreated middle distillate stream of catalytic cracker (viz. LCO) as the only feed to R-2 reactor, the Cetane number of Cut-3 (UCO) is below 42, preferably below 39 and more preferably below 35. However, on introducing hydrotreated middle distillate of thermal cracker (viz. CGO) in the Bed-2 or Bed-3 of R-2 reactor, the cetane number of Cut-3 improves above 46, preferably above 48 and more preferably above 51.

In one embodiment, on co-feeding hydrotreated middle distillate streams from both catalytic and thermal crackers to Bed-1 of the R-2 reactor, the cracking of paraffin molecules present in the thermal cracker stream takes place significantly and also contributes significantly to the quantity in the Cut-2, thereby diluting aromatic concentration of Cut-2.

In yet another embodiment, the concentration of aromatics in the Cut-2 is above 50 wt. %, preferably above 60 wt. % and more preferably above 65 wt. %. The RON of Cut-2 stream is above 85, preferably above 92 and more preferably above 95.

The Cut-1 stream enriched with iso-paraffin and naphthene molecules has a RON of between 84 to 92 units and more preferably between 84 and 90 units. The n-paraffin in Cut-1 is below 10 wt. %, preferably below 5 wt. % and more preferably below 2 wt. %.

In one embodiment, the per-pass conversion in R-2 is maintained below 75 wt. %, preferably below 65 wt. % and more preferably below 60 wt. %. In any circumstance, the per-pas conversion is always above 55 wt. %. The restriction in per-pass conversion is essential for maintaining low yield of LPG and Light naphtha (Cut-1). With increase in per-pass conversion, the yield of LPG and light naphtha becomes high, thereby lowering the yield of Cut-2. Maintaining low per-pass conversion is also essential for lowering the chemical hydrogen consumption and benzene concentration in Cut-1. The conversion for the process is defined by:

$$Coversion\,(wt\ \%) = \frac{wtof\ 200^\circ\ C.\ (+)inproduct}{wtof\ 200^\circ\ C.\ (+)infeed} \times 100$$

Figure 2:
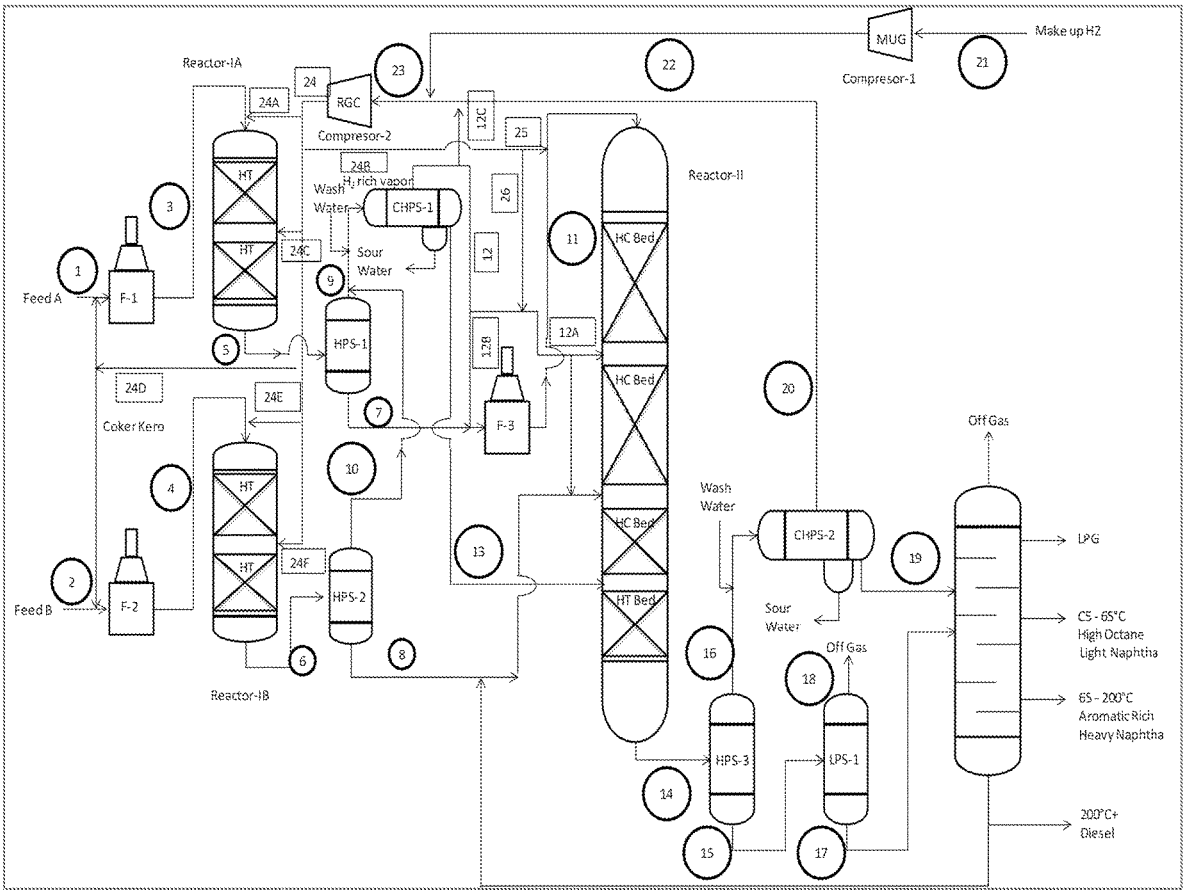
FIG. 2 illustrates the process flow scheme.

FIG. 2 discloses the Feed-A (Middle distillate from catalytic cracking unit) introduced into Reactor-1A via line-3 after heating in heater F-1. The effluent of Reactor-1A is sent to HPS-1 through line-5. The vapor and the liquid effluent of Reactor-1A get separated and the vapor containing unreacted hydrogen is sent to CHPS-1 through line-9. The liquid effluent is sent to Reactor-2 via line-11 after heating to reaction temperature in Heater F-3.

The Feed-B (Middle distillate from thermal cracking unit) is introduced into Reactor-1B through line-4 after heating in heater F-2. The effluent of Reactor-1B is sent to HPS-2 through line-6. The vapor and the liquid effluent of Reactor-1B get separated and the vapor containing unreacted hydrogen is sent to CHPS-1 through line-10 and line-9. The liquid effluent is introduced into second/third bed of Reactor-2 via line-8.

The vapor containing unreacted hydrogen and $H_2S$ from CHPS-1 is sent to RGC after getting scrubbed in the high-pressure scrubber. The condensed liquid from CHPS-1 is sent to the fourth/last bed of Reactor-2. The last bed of Reactor-2 is the hydrotreating catalyst bed, provided to treat recombinant mercaptan.

A part of CHPS-1 vapor rich in hydrogen is also mixed with HPS-1 bottom effluent via line-12B before being introduced into F-3 for heating. The CHPS-1 vapor also contains $H_2S$ which helps maintain the Reactor-2 catalyst in sulfide form. This is essential because, the sulphur content in the HPS-1 effluent is low.

The effluent from Reactor-2 is sent to HPS-3. The bottom of HPS-3 is then sent to LPS-1. The top effluent of HPS-3 is sent to CHPS-2. The CHPS-2 vapor rich in hydrogen is then sent to RGC along with CHPS-1 vapor. Before being sent to RGC, both CHPS-1 and CHPS-2 vapor are scrubbed in high pressure amine scrubber.

The bottom effluent of LPS-1 is routed to fractionators for generating Cut-1, Cut-2, and Cut-3. The Cut-3 is recycled back to Reactor-2 via line-27 and line-8.

EXAMPLES

Having described the basic aspects of the present invention, the following non-limiting examples illustrate specific embodiment thereof. Those skilled in the art will appreciate that many modifications may be made in the invention without changing the essence of invention. The process of present invention is exemplified by the following non-limiting examples.

Illustrative Example

Experiment was conducted in a fixed bed micro reactor unit (MRU) with two feed streams. Feed-A was LCO obtained from a RFCC unit and Feed-2 was CGO obtained from a delayed Coker unit. The characterization for Feed-1 and Feed-2 are given below in Table 2.

TABLE 2

| Feed properties | | |
|---|---|---|
| Attributes | Feed-1 (LCO) | Feed-2 (CGO) |
| Specific Gravity at 15° C., IS: 1448 - P: 32 | 0.9897 | 0.8650 |
| Total Sulphur (ASTM D2622), wt. % | 0.42 | 1.50 |
| Total Nitrogen (ASTM D4629), ppmw | 431 | 855 |
| Distillation, D- 2887, wt. % | ° C. | |
| 5 | 203 | 215 |
| 50 | 274 | 285 |
| 90 | 348 | 353 |
| 95 | 376 | 369 |
| Aromatics by HPLC | wt. % | |
| Saturates | 10.1 | 68.8 |
| Monoaromatics | 12.1 | 15.0 |
| Di aromatics | 66.5 | 12.7 |
| PAH | 11.3 | 3.5 |
| Cetane Number (ASTM D 613) | <25 | 43 |

Example 1

The Feed-1 is first subjected to hydrotreatment in Reactor-1 (R-1) and the effluent of R-1 is then subjected to hydrocracking in Reactor-2 (R-2). The R-1 and R-2 catalysts are typical hydrotreating and hydrocracking catalysts, respectively. The feed rate to R-1 and the volume of hydrotreating catalyst in R-1 is sufficient for maintaining nitrogen-slippage below 20 ppmw. The volume of hydrocracking catalyst in R-2 is sufficient for maintaining the LHSV 'X $h^{-1}$'. The Weighted average bed temperature (WABT) of R-1 and R-2 are maintained between 300-370° C. and 340-400° C., respectively. The hydrogen partial pressure and $H_2$/HC ratio are maintained between 25-75 bar g and 800-2000 $Nm^3/m^3$. The hydrocracker reactor outlet product is fractionated and the three cuts viz. Cut-1 (IBP-65° C.), Cut-2 (65-200° C.) and Cut-3 (200° C.+) are generated. The characterizations of the reactor outlet product and the three cuts are given below in Tables 3 and 4, respectively. The component analysis of Cut-3 has been provided in Table-5.

TABLE 3

| Product properties | |
|---|---|
| Attributes | Values |
| Specific Gravity at 15° C., IS: 1448 - P: 32 | 0.8074 |
| Total Sulphur (ASTM D2622), ppmw | 10 |
| Total Nitrogen (ASTM D4629), ppmw | 1 |
| Distillation, D- 2887, wt. % | ° C. |
| 5 | 35 |
| 30 | 118 |
| 50 | 172 |
| 70 | 237 |
| 95 | 345 |
| Aromatics | wt. % |
| Saturates | 27.5 |
| Monoaromatics | 49.9 |
| Di aromatics | 19.5 |
| Polyaromatics | 3.1 |

TABLE 4

| Properties of the cuts | | | |
|---|---|---|---|
| Attributes | Cut-1 (IBP-65° C.) | Cut-2 (65-200° C.) | Cut-3 (200° C.+) |
| Specific Gravity at 15° C., IS: 1448 - P: 32 | 0.6528 | 0.8287 | 0.8844 |
| Total Sulphur (ASTM D2622), ppmw | <1 | <5 | 8 |
| Total Nitrogen (ASTM D4629), ppmw | <1 | <1 | <1 |
| Distillation, D-2887, wt. % | ° C. | ° C. | ° C. |
| 5 | 22 | 74 | 198 |
| 30 | 31 | 109 | 220 |
| 50 | 51 | 130 | 238 |
| 70 | 56 | 142 | 270 |
| 95 | 79 | 185 | 348 |
| RON (ASTM D2699) | 84 | 96.2 | NA |
| Cetane Number (ASTM D 613) | NA | NA | <30 |

TABLE 5

| Component Analysis of Cut 3 | |
|---|---|
| Mass Spectrometry analysis-22 classes | wt. % |
| Paraffins | 17.4 |
| Mono-cycloparaffins | 3.5 |
| Di-cycloparaffins | 5.2 |
| Tri-cycloparaffins | 8.9 |
| Total Saturates | 35.0 |
| Mono-aromatics | |
| Alkylbenzenes | 22.1 |
| Benzo-cyclo-paraffins | 24.6 |
| Benzo-dicyclo-paraffins | 2.3 |
| Di-aromatics | |
| Naphthalene | 11.2 |
| Acenaphthene, biphenyls | 2.4 |
| Acenaphthylenes, fluorenes | 2.1 |
| Tri-aromatics | |
| Phenanthrenes | 0.1 |
| Pyrenes | 0.0 |
| Total Aromatics | 65.0 |
| Sulphur compound | 0.0 |

Example 2

The Feed-1 and Feed-2 are subjected to hydrotreatment in two separate fixed bed micro reactor units. The operating conditions are so maintained that the N-slippage at the reactor outlets is less than 20 ppmw. Same hydrogen partial pressures are maintained for both the units so that entire unit is operated with a single recycle gas compressor as mentioned the description for FIG. 2. The hydrotreated Feed-1 and Feed-2 is then subjected to hydrocrack in two separate fixed bed Micro reactor units. The catalyst volume and feed rate are adjusted for maintaining LHSV of Feed-1 and Feed-2 'X $h^{-1}$'. The 'Hydrogen partial pressure', 'WABT' and 'hydrogen to hydrocarbon ratio' have been maintained in similar range as explained in Example-1. The hydrocracker reactor outlet products are then mixed in 1:1 proportion and further, subjected to fractionation. Three fractions [viz. Cut-1 (IBP-65° C.), Cut-2 (65-200° C.) and Cut-3 (200° C.+)] have been generated. The characterizations of the three fractions are given below in Table-6. The component analysis of Cut-3 has been provided in Table-7.

TABLE 6

| Properties of the Cuts | | | |
|---|---|---|---|
| Attributes | Cut-1 (IBP-65° C.) | Cut-2 (65-200° C.) | Cut-3 (200° C.+) |
| Specific Gravity at 15° C., IS: 1448 - P: 32 | 0.6528 | 0.7991 | 0.8756 |
| Total Sulphur (ASTM D2622), ppmw | <1 | <5 | <10 |
| Total Nitrogen (ASTM D4629), ppmw | <1 | <1 | <1 |
| Distillation, D-2887, wt. % | ° C. | ° C. | ° C. |
| 5 | 20 | 69 | 194 |
| 30 | 29 | 95 | 217 |
| 50 | 46 | 112 | 232 |
| 70 | 52 | 139 | 249 |
| 95 | 75 | 185 | 328 |
| RON (ASTM D2699) | 83 | 91 | NA |
| Cetane Number (D 7668) | NA | NA | 35 |

TABLE 7

| Component analysis of Cut 3 | |
|---|---|
| Mass Spectrometry analysis-22 classes | wt. % |
| Paraffins | 18.3 |
| Mono-cycloparaffins | 7.2 |
| Di-cycloparaffins | 11.6 |
| Tri-cycloparaffins | 8.9 |
| Total Saturates | 46.0 |
| Mono-aromatics | |
| Alkylbenzenes | 23.1 |
| Benzo-cyclo-paraffins | 17.8 |
| Benzo-dicyclo-paraffins | 2.1 |
| Di-aromatics | |
| Naphthalene | 8.1 |
| Acenaphthene, biphenyls | 2.1 |
| Acenaphthylenes, fluorenes | 0.9 |
| Tri-aromatics | |
| Phenanthrenes | 0.0 |
| Pyrenes | 0.0 |
| Total Aromatics | 54.0 |
| Sulphur compound | 0.0 |

Example 3

The Feed-1 and Feed-2 are subjected to hydrotreatment in two separate fixed bed reactor units. The operating conditions are so maintained that the N-slippage at the reactor outlets is less than 20 ppmw. Same hydrogen partial pressure for both the units has been maintained so that entire unit is operated with a single recycle gas compressor. The hydrotreated Feed-1 and Feed-2 is then subjected to hydrocracking in two separate fixed bed micro reactor units. The catalyst volume and feed rate are adjusted for maintaining LHSV of Feed-1 and Feed-2 at 'X $h^{-1}$' and '3X $h^{-1}$', respectively. The 'Hydrogen partial pressure', 'WABT' and 'hydrogen to hydrocarbon ratio' are maintained in the same range as explained in Example-1. The hydrocracker reactor outlet products are then mixed in 1:1 proportion and further, subjected to fractionation. Three fractions [Cut-1 (IBP-65° C.), Cut-2 (65-200° C.) and Cut-3 (200° C.+)] are generated. The characterizations of the three cuts are given below in Table 8. The component analysis of Cut-3 has been provided in Table-9.

TABLE 8

| Properties of the Cuts | | | |
|---|---|---|---|
| Attributes | Cut-1 (IBP-65° C.) | Cut-2 (65-200° C.) | Cut-3 (200° C.+) |
| Specific Gravity at 15° C., IS: 1448 - P: 32 | 0.6504 | 0.7794 | 0.8658 |
| Total Sulphur (ASTM D2622), ppmw | <1 | <5 | <10 |
| Total Nitrogen (ASTM D4629), ppmw | <1 | <1 | <1 |
| Distillation, D-2887, wt. % | ° C. | ° C. | ° C. |
| 5 | 22 | 65 | 179 |
| 30 | 32 | 92 | 203 |
| 50 | 50 | 110 | 223 |
| 70 | 55 | 135 | 246 |
| 95 | 74 | 178 | 330 |
| RON (ASTM D2699) | 86.5 | 94 | NA |
| Cetane Number (D 7668) | NA | NA | 44 |

TABLE 9

| Component analysis of Cut 3 | |
|---|---|
| Mass Spectrometry analysis-22 classes | wt. % |
| Paraffins | 26.2 |
| Mono-cycloparaffins | 9.6 |
| Di-cycloparaffins | 8.7 |
| Tri-cycloparaffins | 11.8 |
| Total Saturates | 56.3 |
| Mono-aromatics | |
| Alkylbenzenes | 20.4 |
| Benzo-cyclo-paraffins | 14.6 |
| Benzo-dicyclo-paraffins | 0.6 |
| Di-aromatics | |
| Naphthalene | 6.1 |
| Acenaphthene, biphenyls | 1.5 |
| Acenaphthylenes, fluorenes | 0.6 |
| Tri-aromatics | |
| Phenanthrenes | 0.0 |
| Pyrenes | 0.0 |
| Total Aromatics | 43.7 |
| Sulphur compound | 0.0 |

The invention claimed is:

1. A process for converting middle distillate range boiling streams from catalytic cracking and thermal cracking units to (i) a high-octane gasoline blending stream, (ii) a high aromatic heavy naphtha, and (iii) a high cetane ultra-low sulfur diesel (ULSD), the process comprising:

(a) subjecting the middle distillate range boiling streams from the catalytic cracking and the thermal cracking units for hydrotreatment in two hydrotreating reactors (R-1A and R-1B) to produce hydrotreated effluents;

(b) subjecting the hydrotreated effluents from the two hydrotreating reactors (R-1A and R-1B) for hydrocracking in a hydrocracker reactor (R-2); and (c) sending a fractionating effluent from the hydrocracker reactor (R-2) for distillation to generate three outlet product cuts—Cut-1, Cut-2 and Cut-3, wherein Cut-1 is the high-octane gasoline blending stream, Cut-2 is the high aromatic heavy naphtha, and Cut-3 is the high cetane ultra-low sulfur diesel (ULSD) or unconverted oil (UCO).

2. The process as claimed in claim 1, wherein the middle distillate range boiling streams from the catalytic cracking unit comprise a light cycle oil (LCO), and wherein the middle distillate range boiling streams from the thermal cracking unit comprise a Coker gas oil (CGO).

3. The process as claimed in claim 2, wherein aromatic molecules of the light cycle oil (LCO) are converted to the high aromatic heavy naphtha suitable for producing benzene, toluene, and xylene (BTX).

4. The process as claimed in claim 2, wherein aromatic molecules of the Coker gas oil (CGO) are converted to the high aromatic heavy naphtha suitable for producing benzene, toluene, and xylene (BTX).

5. The process as claimed in claim 2, wherein saturated molecules of the Coker gas oil (CGO) are simultaneously converted to the high-cetane ultra-low sulfur diesel (ULSD) or the unconverted oil (UCO) with a cetane number (CN) of more than 51.

6. The process as claimed in claim 2, wherein the light cycle oil (LCO) and the Coker gas oil (CGO) are hydrotreated in separate hydrotreating reactors (R-1A and R-1B) in step (a) to obtain hydrotreated light cycle oil (LCO) and hydrotreated Coker gas oil (CGO).

7. The process as claimed in claim 6, wherein the hydrotreated light cycle oil (LCO) and the hydrotreated Coker gas oil (CGO) are processed together in step (b) in the hydrocracker reactor (R-2) with a mild hydrocracking catalyst;

wherein the hydrotreated light cycle oil (LCO) rich in naphtha-benzene is fed to a first catalyst bed in the hydrocracker reactor (R-2); and wherein the hydrotreated Coker gas oil (CGO) rich in paraffin and long chain alkylated benzene is fed to a second or a third catalyst bed in the hydrocracker reactor (R-2).

8. The process as claimed in claim 1, wherein the high-octane gasoline blending stream (Cut-1) has a boiling point in a range of C5-95° C., and a research octane number (RON) in a range of 80-95; wherein C5 is boiling point of pentane and its isomers.

9. The process as claimed in claim 1, wherein the high aromatic heavy naphtha (Cut-2) has a boiling point in a range of 95-210° C., an aromatic content in a range of 50-80 wt. %, and a research octane number (RON) in a range of 90-105.

10. The process as claimed in claim 1, wherein the high cetane ultra-low sulfur diesel (ULSD) or the unconverted oil (UCO) (Cut-3) has a boiling point of more than 210° C.

11. The process as claimed in claim 1, wherein sulfur content of the Cut-1, Cut-2 and Cut-3 is below 10 ppmw.

* * * * *